US005967681A

United States Patent [19]

Leys et al.

[11] Patent Number: 5,967,681

[45] Date of Patent: Oct. 19, 1999

[54] THERMAL PRINTER WITH SHEET FEEDING MEANS

[75] Inventors: Paul Leys, Kontich; Daniel Verbeek, Heist-op-den !Berg, both of Belgium

[73] Assignee: Agfa-Gevaert, Mortsel, Belgium

[21] Appl. No.: 08/978,000

[22] Filed: Nov. 25, 1997

Related U.S. Application Data

[60] Provisional application No. 60/036,810, Feb. 3, 1997.

[30] Foreign Application Priority Data

Nov. 28, 1996 [EP] European Pat. Off. ..... 96203359

[51] Int. Cl.[6] ..... B41J 13/02

[52] U.S. Cl. ..... 400/636; 400/624; 400/579; 271/233

[58] Field of Search ..... 400/578, 579, 400/630, 636, 624, 605; 347/218; 271/226, 233, 241, 253

[56] References Cited

U.S. PATENT DOCUMENTS

| | | | |
|---|---|---|---|
| 4,550,902 | 11/1985 | Godlewski | 271/233 |
| 4,739,983 | 4/1988 | Ide et al. | 271/233 |
| 4,888,602 | 12/1989 | Watanabe et al. | 346/134 |
| 5,165,675 | 11/1992 | Kanaya | 271/233 |
| 5,232,216 | 8/1993 | Bybee | 271/233 |
| 5,308,175 | 5/1994 | Ito | 400/605 |

FOREIGN PATENT DOCUMENTS

| | | |
|---|---|---|
| 0485786 | 5/1992 | European Pat. Off. . |
| 2069468 | 8/1981 | United Kingdom . |
| 2297315 | 7/1996 | United Kingdom . |

*Primary Examiner*—Christopher A. Bennett
*Attorney, Agent, or Firm*—Baker & Botts, L.L.P.

[57] ABSTRACT

A thermal printer (10) with a thermal head (16) for image-wise heating a heat-sensitive sheet according to an elongate printing zone, which comprises sheet feeding means having a sheet advancing mode for feeding a sheet with its leading end through the gap between the print drum (15) and the thermal head (16) of this printer beyond the position it should take at the start of printing, and a sheet-returning mode in which the sheet can move backwardly, and a stop (44, 52) against which the backwardly moving sheet abuts with its trailing edge for its longitudinal alignment, thereby to obtain with its leading end the correct printing start position in the gap.

10 Claims, 12 Drawing Sheets

THERMAL PRINTER WITH SHEET FEEDING MEANS

The application claims the benefit of the U.S. Provisional Application No. 60/036,810, filed Feb. 3, 1997.

BACKGROUND OF THE INVENTION

1. Field of the Invention

The present invention relates to a thermal printer with a thermal head for line-wise heating a heat-sensitive sheet to produce an image, in particular an image on a transparent support, for medical diagnostic purposes.

2. Description of the Prior Art

Thermal imaging or thermography is a recording process wherein images are generated by the use of image-wise modulated thermal energy.

In thermography two approaches are known:

1. Direct thermal formation of a visible image pattern by the image-wise heating of a recording material containing matter that by chemical or physical process changes colour or optical density.
2. Thermal dye transer printing wherein a visible image pattern is formed by transfer of a coloured species from an image-wise heated donor element into a receptor element.

A survey of "direct thermal" imaging methods is given in the book "Imaging systems" by Kurt I. Jacobson-Ralph E. Jacobson, The Focal Press—London and New York (1976), Chapter VII under the heading "7.1 Thermography".

Common thermal printers comprise a rotatable drum and an elongate thermal head which is spring-biased towards the drum to firmly line-wise contact a heat-sensitive material which is passed between the head and the drum.

The thermal head includes a plurality of heating elements and corresponding drivers and shift registers for these elements. The image-wise heating of a sheet is performed on a line by line basis, with the heating resistors geometrically juxtaposed along each other in a bead-like row running parallel to the axis of the drum. Each of these resistors is capable of being energised by heating pulses, the energy of which is controlled in accordance with the required density of the corresponding picture element.

It is common practice to compensate for across-the-head unevenness. An example of a compensation method has been described in patent application EP-A-0 627 319. According to this method, which is applicable to direct thermal and thermal transfer printing processes, a test print is produced. Density values are measured on this test print and deviations of measured density values from desired values are used to calculate a set of correction values for each heating element.

The test print is produced by first measuring the electrical resistance of each heating element of the printhead and then driving the elements so that the same electrical power as a time average is converted in each of the heating elements.

By the use of the "power-compensated control data" instead of uncorrected control data both in the determination of the density correction factors and during each printing operation, the uniformity of the print results is improved.

In thermal dye transfer the sheet, i.e. the image receiving sheet, is attached to the rotatable drum, and a dye donor sheet or web is conveyed by frictional contact with the rotating sheet past the thermal head.

In direct thermal image formation, a single heat-sensitive sheet is conveyed between the thermal head and the drum, and the image is directly produced in the sheet. The sheet is not attached to the drum but is advanced between the head and the drum by frictional contact of its rear side with the drum.

The present invention is concerned with such direct thermal image formation.

A difficulty with direct thermal image formation is the exact location of the heat-sensitive sheet between the print drum and the thermal head, prior to printing.

In thermal dye transfer printing the image receiving sheet is clamped on the print drum and, prior to printing, the thermal head is lifted from the drum to allow the clamp to pass under the head and the print drum to take the correct angular position in which the leading sheet end extends just beyond the thermal head. In other words, careful control of the angular position of the drum automatically entails the correct start position of the leading sheet end.

In direct thermal image formation, on the contrary, the leading sheet end is freely passed between head and drum before the head becomes urged towards the drum to start printing. The correct position of the leading sheet end preparatory to printing is very important since once the head is closed, the sheet position with respect to the drum can no longer be altered. Although the size of the, unprinted, leading end of the sheet is important in printing positive-type conventional images, it is even more important in printing negative-type images on a transparent support, such as images on a transparent support for medical diagnostic purposes. Examples of medical diagnosis are echograms, CT scans and NMR images which all are negative-type images, what means that the overall background is substantially black, the image details having lesser optical densities. The support of the image-receiving sheet in such application is polyethylene terephthalate or a similar material, the edges of which are often sharp and destructive for any surface in sliding contact therewith. For that reason the width of the sheet to be printed may be smaller than the length of the thermal head but the lateral sheet margins are not printed, and the head is put in contact with the sheet only after the front edge thereof has passed, and removed before the trailing edge of the sheet arrives. Further, the sheet is duly laterally aligned before the thermal head takes its printing position. The result of all this is an unprinted, transparent marginal frame surrounding the image on the sheet which as such is not disturbing because its width is of the order of magnitude of 5 mm only. For reasons of appearance, however, it is important that this margin be of uniform width and thus it is clear that the printing apparatus should provide a very accurate control of the longitudinal and lateral sheet position prior to printing.

SUMMARY OF THE INVENTION

Object of the Invention

It is the object of the invention to provide a thermal printer for producing an image in a heat-sensitive sheet, which provides excellent control of the longitudinal position of the leading end of a sheet between the thermal head and the print drum, prior to starting printing.

Statement of the Invention

In accordance with the present invention, a thermal printer with a thermal head for image-wise heating a heat-sensitive sheet according to an elongate printing zone, transverse with respect to the sheet, and a rotatable, driven print drum for conveying such sheet past such thermal head while the head is urged towards the drum, said thermal head having a rest position remote of the print drum allowing the leading end of a sheet to pass freely through the gap between such head and drum, and an operative one in which it urges the sheet onto such drum for printing, is characterised in that it comprises sheet feeding means having a sheet-forwarding mode for moving a sheet with its leading end through said gap beyond the position it should take at the start of printing, and a sheet-returning mode in which the sheet moves backwardly for contacting with its trailing edge stop means for its longitudinal alignment, thereby to obtain with its leading end the correct printing start position in said gap.

It is clear that the success of the described method of positioning depends on the precision of the sheet size. As a matter of fact, the trailing sheet edge being used as a reference for the longitudinal sheet position, it is the sheet length as such that determines the position of the leading end of the sheet. Common tolerances of photographic sheets are such that no difficulties exist in this respect.

The print drum and the thermal head of a printer in accordance with the invention are suitably disposed in such a way that a sheet can be freely passed through the gap between them according to an upwardly directed course. This has the advantage that a sheet can be passed through said gap to a position beyond its intended one, and then be allowed to move back merely under the influence of gravity until its trailing edge engages the mentioned stop. Suchlike arrangement is simple and reliable in operation. However, the sheet feeding means may also be arranged to supplement the effect of gravity by driving the sheet backwardly.

Suitable embodiments of a thermal printer according to the invention are as follows.

The printer comprises means for adjusting the lateral position of the sheet after or before its longitudinal adjustment by said stop means.

The printer comprises a holder for holding a stack of sheets to be fed in a position tilted to the vertical, dispenser means for dispensing each time the upper sheet from a stack of sheets held in such position, and for feeding such sheet with its leading end through the gap between print drum and opened thermal head. The location of the supply stack of sheets in a position tilted to the vertical leads to a reduced foot print of the apparatus.

The sheet stop can be arranged for being mounted at different heights on said holder depending on a particular sheet size.

A thermal printer according to the present invention is particularly suited for being used in conjunction with the improvement disclosed in our co-pending European patent application No. 96 20 3361 filed on even day herewith, that is on Nov. 28, 1996. This application relates to a thermal printer with one or a plurality of pressure rollers for increasing the angular contact area of a print-receiving sheet with a print drum.

BRIEF DESCRIPTION OF THE DRAWINGS

The invention will be described hereinafter by way of example with reference to the accompanying drawings, wherein.

DETAILED DESCRIPTION OF THE INVENTION

Figure 1:
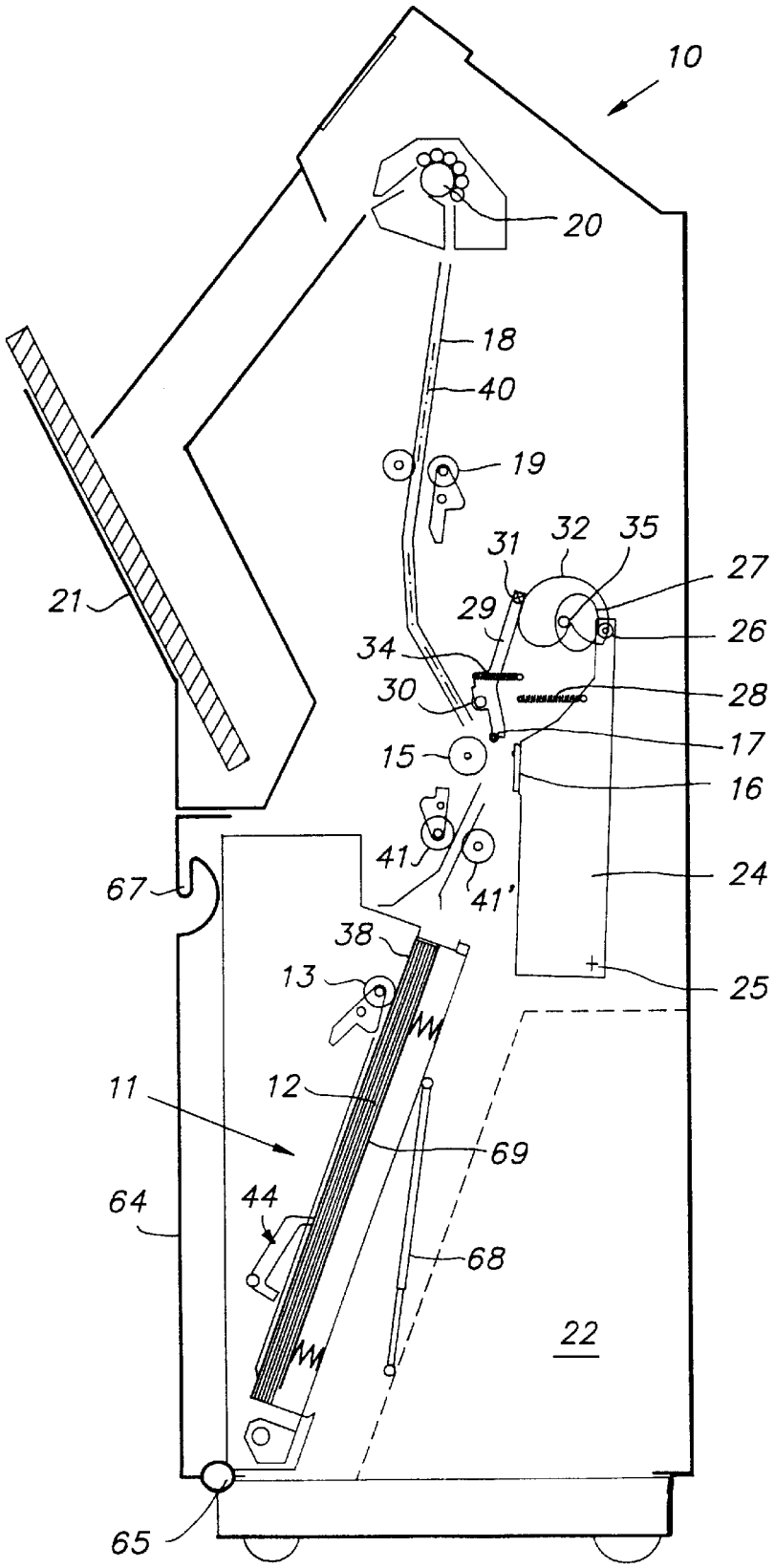
FIG. 1 is a diagrammatic view of one embodiment of a thermal printer according to the invention.

FIG. 1 shows the general layout of one embodiment of a thermal printer according to the invention.

The apparatus is mounted in a housing 10 which comprises a magazine 11 for holding a stack 12 of sheets to be printed in an inwardly tilted position, a dispenser roller 13 for removing the sheets one by one from the stack and for feeding them upwardly, a driven print drum 15, a thermal head 16, a pressure roller 17, guides 18 with sheet driving rollers 19, a de-curl roller 20, an outlet tray 21, and control means 22 for controlling image acquisition and processing. Thermal head 16 is mounted on a rigid frame 24 which is pivotable about axis 25 running strictly parallel with the print drum axis. Frame 24 bears at its free end a follower roller 26 riding on a rotatable cam 27. A tension spring 28 urges the frame in the direction of the print drum.

Figure 2:
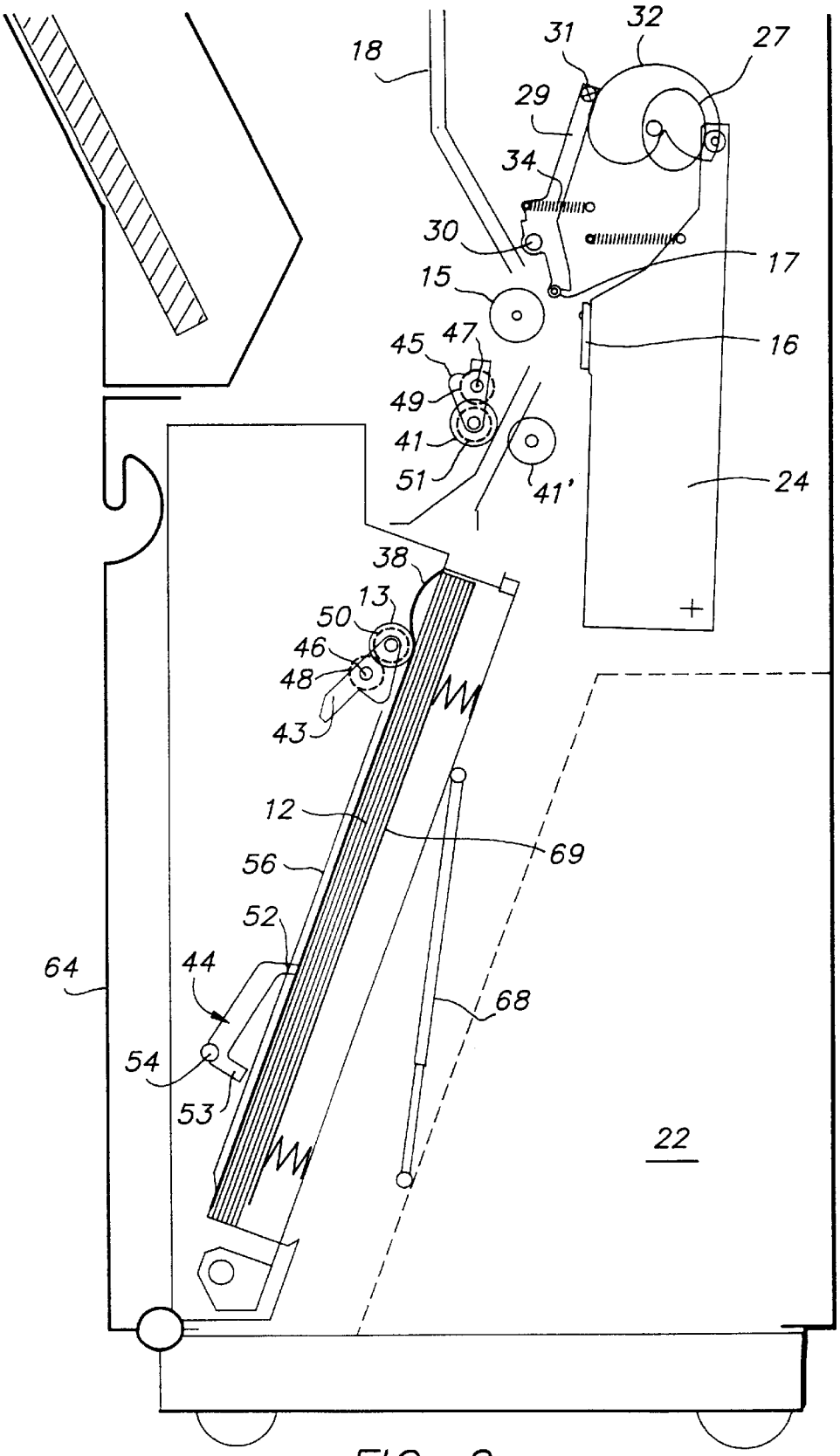
FIG. 2 is an enlarged view of the printer of FIG. 1 showing the start of the removal of a sheet from a supply of sheets.

Pressure roller 17 is mounted for free rotation in a frame 29, see also enlarged FIG. 2, which is pivotable about shaft 30 running likewise parallel to the print drum. Frame 29 bears at its free end a follower roller 31 riding on a cam 32. A tension spring 34 causes frame 29 to urge roller 17 towards the print drum. Both cams 27 and 32 are mounted in the angular relationship as shown, on a common shaft 35 which is rotatable by a motor.

The operation of the thermal printer described hereinbefore is as follows with reference to FIGS. 1 to 5.

Dispenser roller 13 is controlled to remove upper sheet 38 from sheet stack 12. In the first instance, this sheet is buckled at its leading end by the abutting of its leading edge against the top wall of the magazine, see FIG. 2. Continued rotation of roller 13 causes the sheet buckle to increase in size until at a certain moment the leading sheet edge jumps over the edge of the magazine after which the sheet becomes further dispensed according to a linear path. The sheet is fed upwardly until its leading end takes a position between print drum 15 and thermal head 16 as shown in FIG. 3.

Sheet 38 is in this example a heat-sensitive sheet having a heat-sensitive layer coated on a polyethylene terephthalate support. The heat-sensitive layer of all sheets faces downwardly in the drawings of FIGS. 1 to 5. Suitable thermographic materials for medical imaging based on silver behenate in thermal working relationship with a reducing agent are disclosed in our co-pending patent applications EP-A-0 669 875, EP-A-0 669 876 and EP-A-0 726 852.

Figure 3:
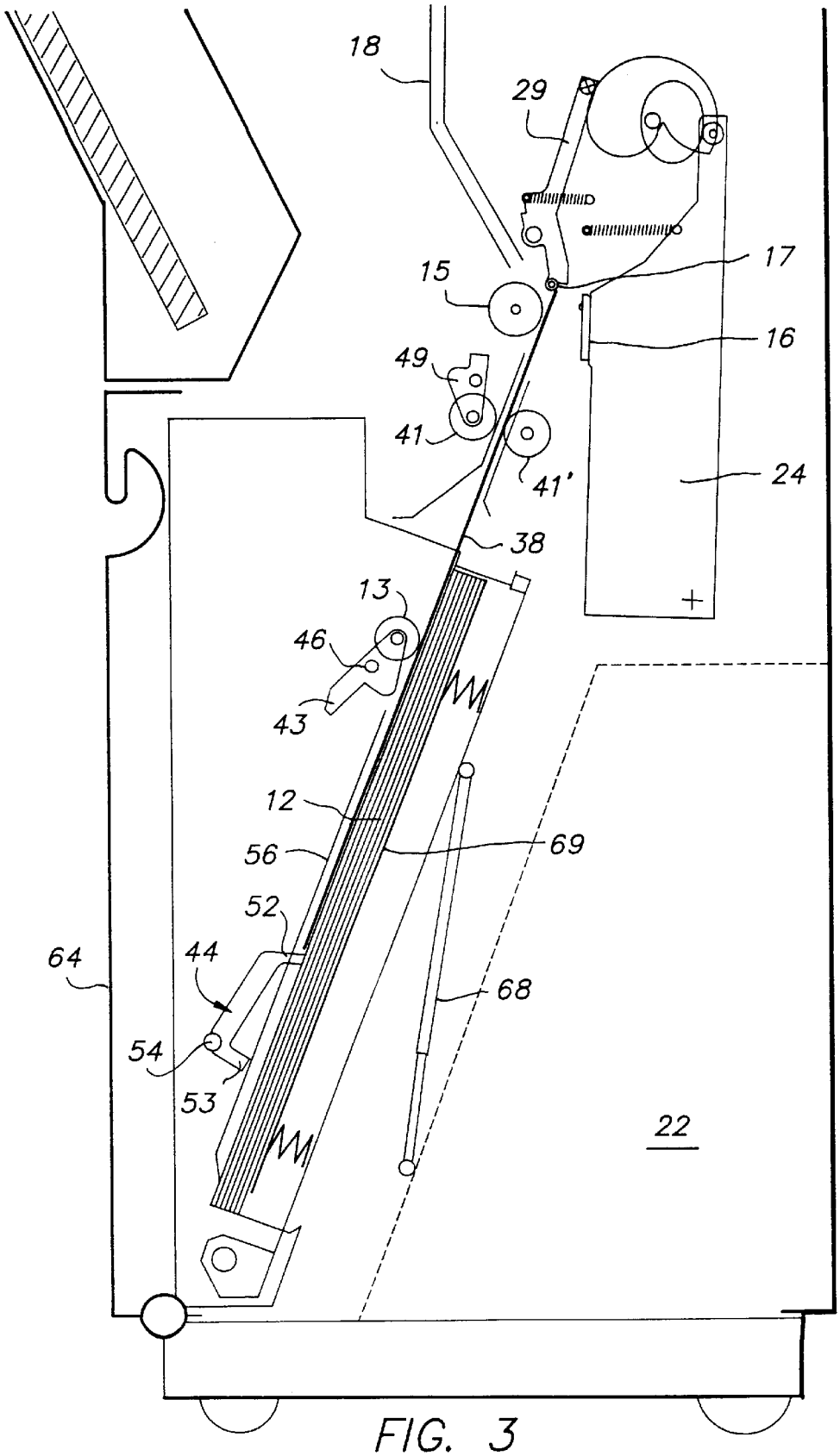
FIG. 3 is an enlarged view showing a sheet being forwarded beyond its intended position in the gap between thermal head and print drum.
Figure 4:
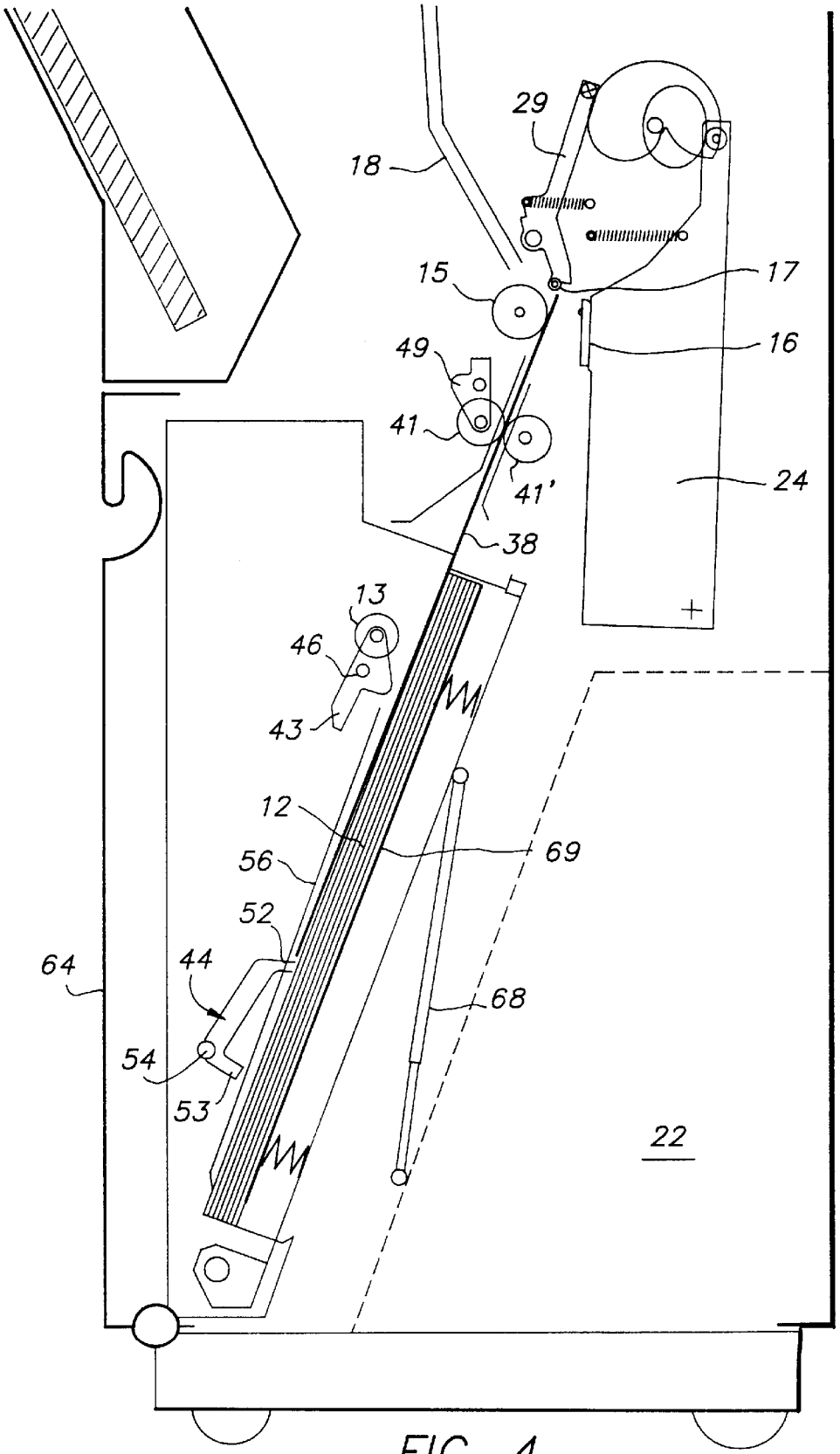
FIG. 4 is an enlarged view showing the sheet having moved backwardly until stopped by contact of its trailing edge with a reference stop.

Next, the driving of dispenser roller 13 is stopped, the roller is removed from sheet stack 12, and roller pair 41, 41' which takes an intermediate position between the sheet stack and the print drum is closed and driven to cause the sheet taking the FIG. 3 position to move backwardly until it abuts with its trailing edge against stop 44, see FIG. 4. It should be understood that gravity on itself may cause the sheet to move downwardly as roller 13 is lifted from the sheet but friction with machine parts and/or electrostatic attraction towards the next sheet, may reduce the mobility of the removed sheet and therefore it may be desirable to improve control over this backward motion by means of sheet driving rollers such as 41, 41'.

The driving momentum of rollers 41, 41' may be limited through appropriate slip clutch means, so that the sheet does not become exaggeratedly buckled as its motion is stopped by contact of its trailing edge with stop 44, or said rollers may be driven by appropriately timing their driving so that this is stopped at the time the sheet contacts the sheet stop.

The sheet now takes a position which is ready for starting preprinting.

Figure 5:
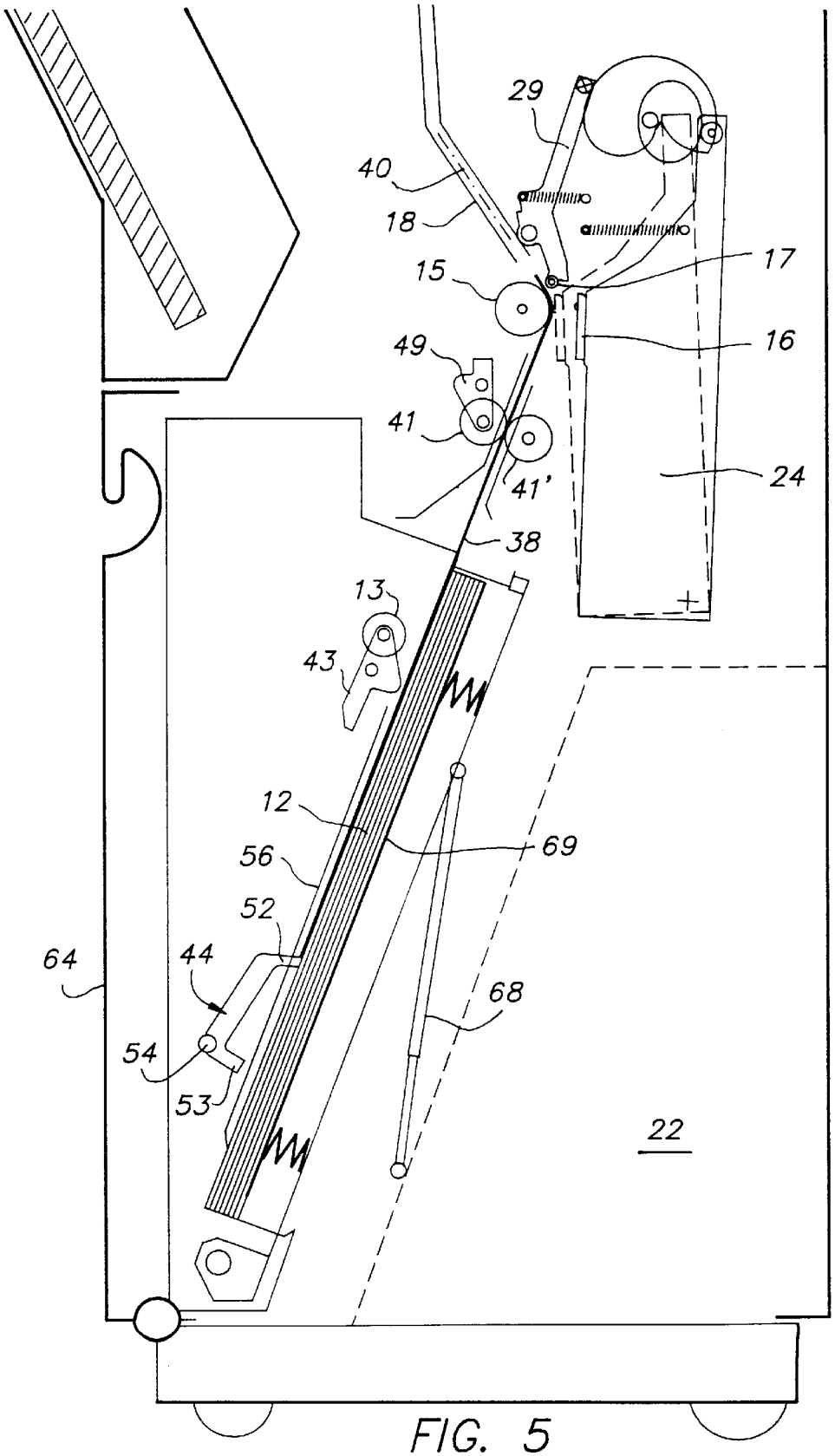
FIG. 5 is an enlarged view showing the thermal head and the pressure roller taking their operative position.

The printhead is closed, see FIG. 5 which shows the printing position of the printhead in broken lines (the corresponding position of the cams has not been shown). Although printing can start up from this moment, the printing quality may be unsatisfactory because of unsufficient control of the speed of the sheet. As a matter of fact, frictional contact between sheet and print drum under the bias of the thermal head is limited to a small area only. Therefore, it is desirable to increase the angle of wrap of the sheet around the drum, and this occurs in the apparatus according to the present embodiment by pressure roller 17 which is moved from its rest position as shown in FIG. 1 to its operative position shown in broken lines in FIG. 5, by appropriate slight further rotation of the cam mechanism (neither this corresponding position of the cams has been shown since it is not required for understanding the operation of feeding and positioning the print sheet). We refer for further details about the cam aspect to our corresponding European patent application No. 96 20 3361 mentioned hereinbefore.

As the sheet is being printed, it is conveyed along path 40 between guide plates 18 up to de-curl roller 20 which is a heated roller in contact with the rear side of the sheet in order to compensate for curling stresses which have been introduced in the sheet by the image-wise heating of its front side. We refer to our co-pending patent application EP-A-0 679 519 wherein the uniform heating of a sheet at its rear side to reduce curl is disclosed.

In this connection it is interesting to know that it is advantageous to keep the sheet drive free from any disturbing influence. The driving and the machining of the de-curl roller are in principle less accurate than those of the print drum and therefore it is desirable not to let interfere the sheet drive of roller 20 with that of drum 15. The length of the sheet path between 15 and 20 is therefore larger than the length of the largest sheet to be printed in the apparatus, and the sheet transport between both said rollers can occur by driven pressure rollers 19 taking an open position as shown in FIG. 1, and being closed as the last image line on the sheet has been printed thereby taking over the sheet drive from the print drum before the trailing sheet edge passes beyond printing array 39.

Sheet feeding rollers 13 and 41 operate in detail as follows. The rollers are mounted between pairs of arms 43 and 45, see FIG. 2, that are pivotable about pivots 46 and 47, respectively. Driven gears 48 and 49 are mounted on the pivots and engage corresponding gears 50 and 51 on the sheet feeding rollers. The driven shaft of these rollers is coupled via a slip clutch with a fixed shaft.

Clockwise rotation of gear 48, driven by a suitable motor, causes arm 43 to swing clockwise as well because the slip clutch on the shaft of gear 50 opposes in a first instance the rotation of the roller. As roller 13 comes in contact with the sheet, further movement of arm 43 is excluded and thus roller 13 starts to rotate, the slip clutch allowing such rotation, and advances the sheet by its corresponding anti-clockwise rotation. Anti-clockwise rotation of gear 48 causes arms 43 to retract from the sheet. The same principle of operation counts for the sheet-returning mode of roller 41, roller 41' being mounted bodily stationary.

Sheet stop 44 is a lever with legs 52 and 53 and is freely pivotable about pivot 54 mounted in a bracket (not shown) making part of the magazine. Leg 52 rests by gravity on the top sheet bf stack 12 and engages the next sheet as the top one is being removed.

Leg 52 freely extends through a corresponding opening in top wall 56 of the magazine.

Figure 6:
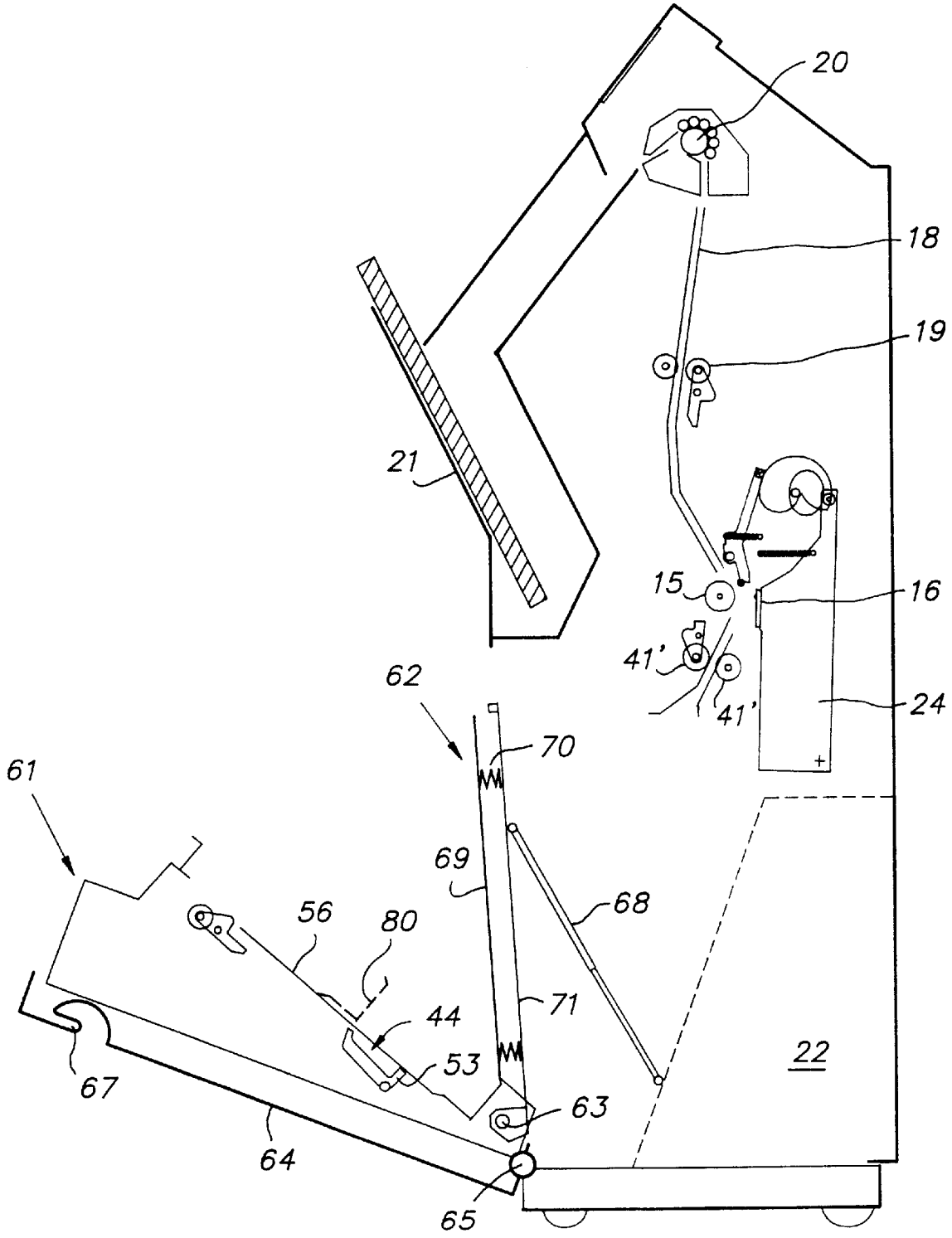
FIG. 6 shows the magazine of the printer of FIG. 1 in its loading position.

The assembly of magazine 11 is as follows with reference to FIGS. 6 and 7.

The magazine is composed of two compartments, viz. an outside one 61 and an inside one 62 being pivotally connected to the outside one at 63. Outside compartment 61 is mounted in lid 64 which is pivotally mounted to the apparatus with hinge 65 and has a handle 67 for its opening and closing.

Sheet stop 44 is swung anti-clockwise under the influence of gravity and rests with its leg 53 against wall 56 of the magazine.

Inside compartment 62 of the magazine is connected at its rear side through a gas spring 68 with a fixed point of the apparatus and takes in the open position of the magazine a nearly vertical position. Said compartment 62 has a sheet pressure plate 69 connected by springs 70 to bottom 71.

Sheet loading is now described with reference to FIGS. 7 to 10. The sheet pack to be loaded may be wrapped according to various techniques, but the one which will now be described by way of example has proved to be extremely convenient in practice and excludes almost any risk for improper manipulation by the operator.

More details about this sheet package are disclosed in our co-pending European patent application No. 96 20 3360 filed on even day herewith, that is on Nov. 28, 1996.

Figure 7:
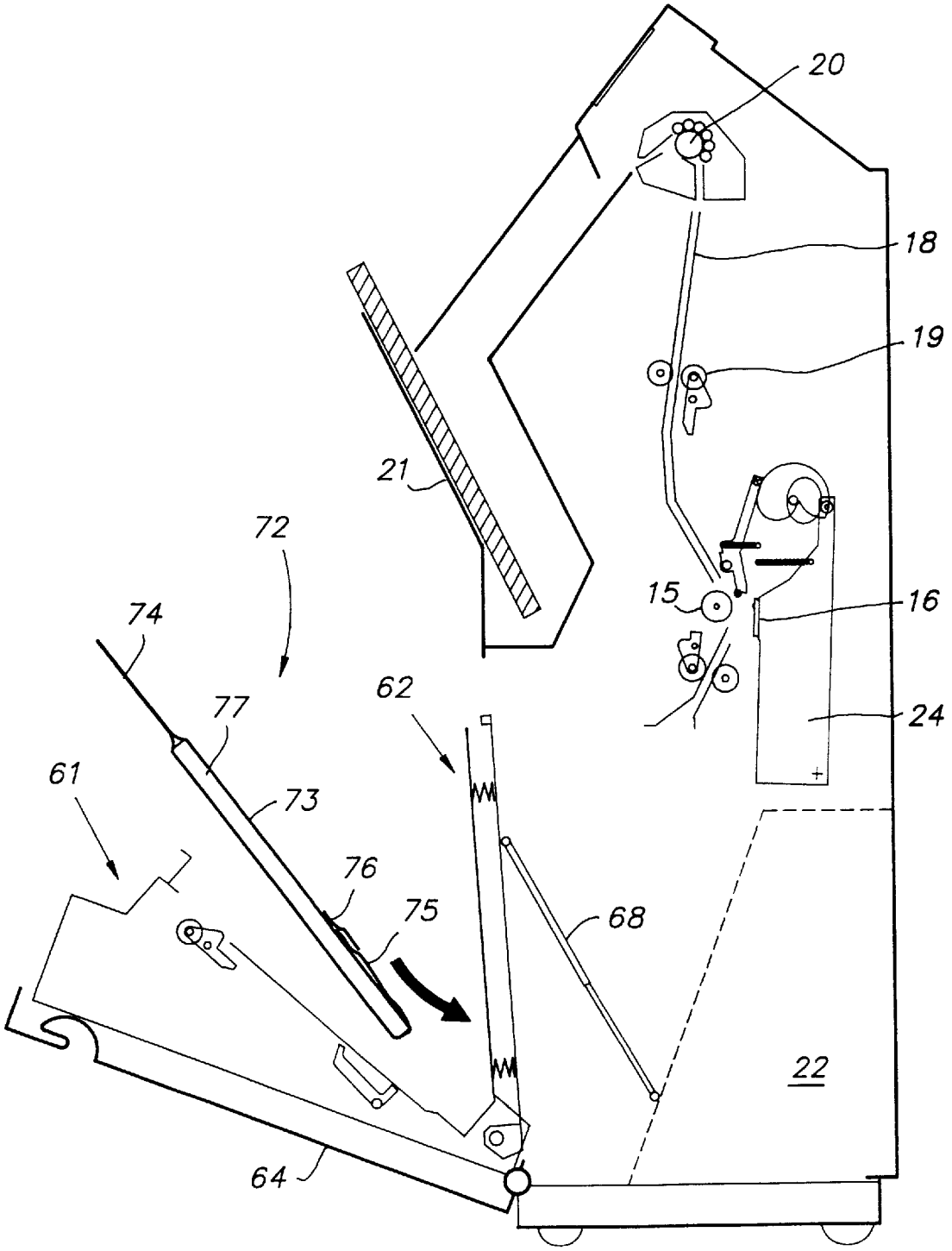
FIG. 7 shows the magazine of FIG. 6 being loaded with a pack of print sheets.

A sheet pack 72 comprising sheet stack 77 wrapped in a moisture-tight sleeve-like wrapper 73 having a closed tail portion 74 and an open front portion 75 back-folded on the pack and kept closed by a sealing tape or warranty label 76, is slid in the open compartment 61 of the magazine as shown by the bold arrow in FIG. 7.

Figure 8:
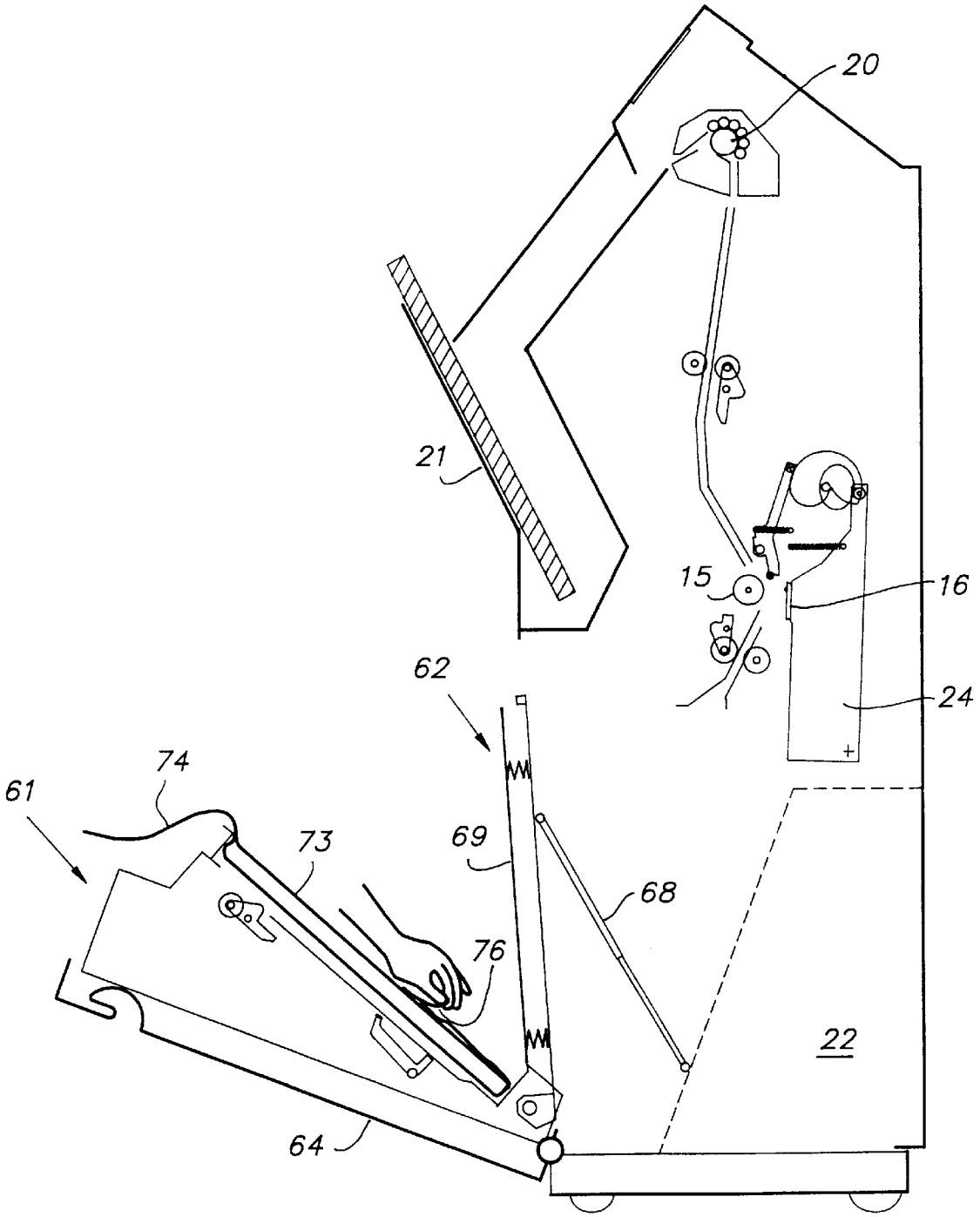
FIG. 8 shows the opening of the sheet pack of FIG. 7.
Figure 9:
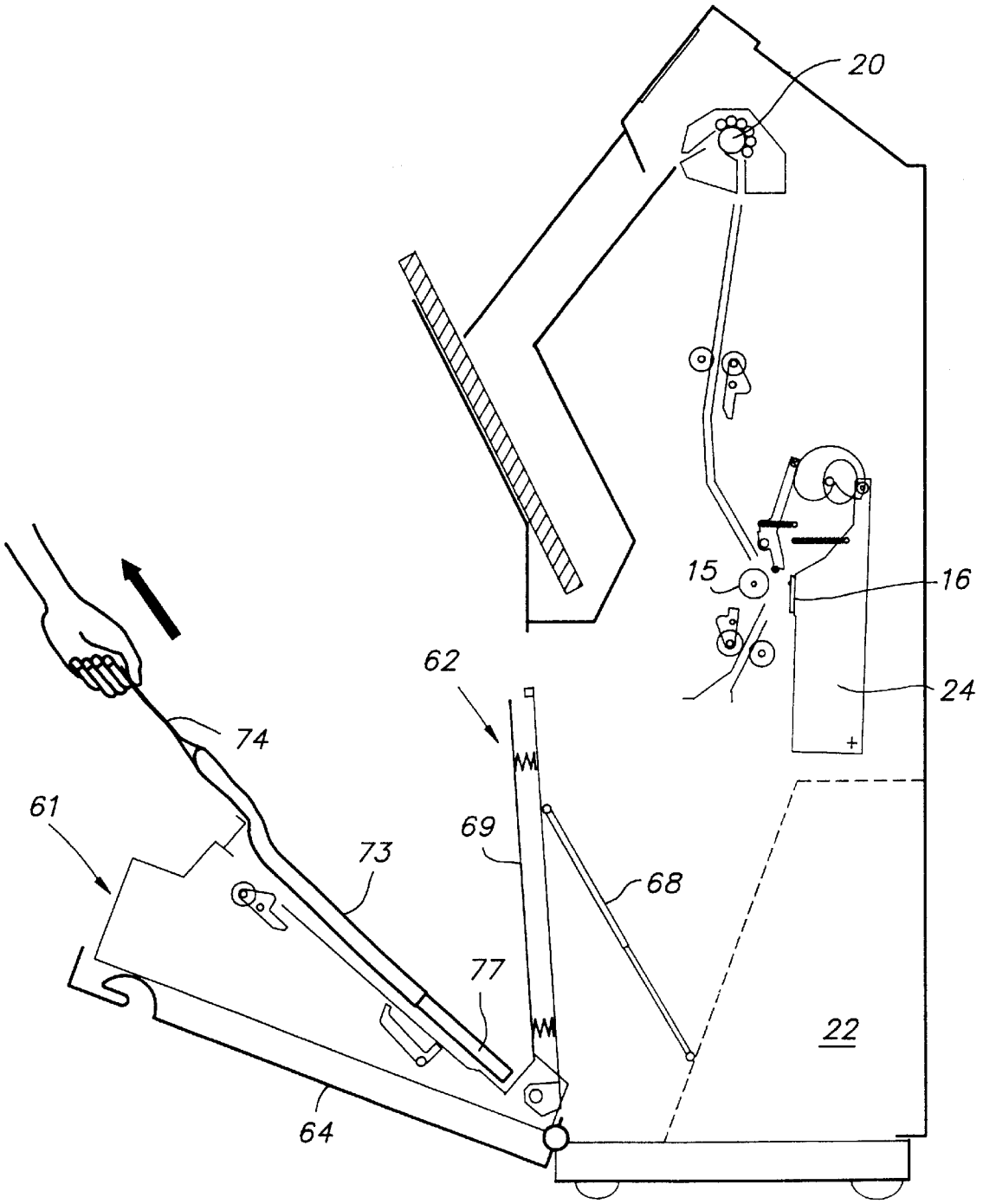
FIG. 9 shows the removal of the wrapping from the sheets of the stack.
Figure 10:
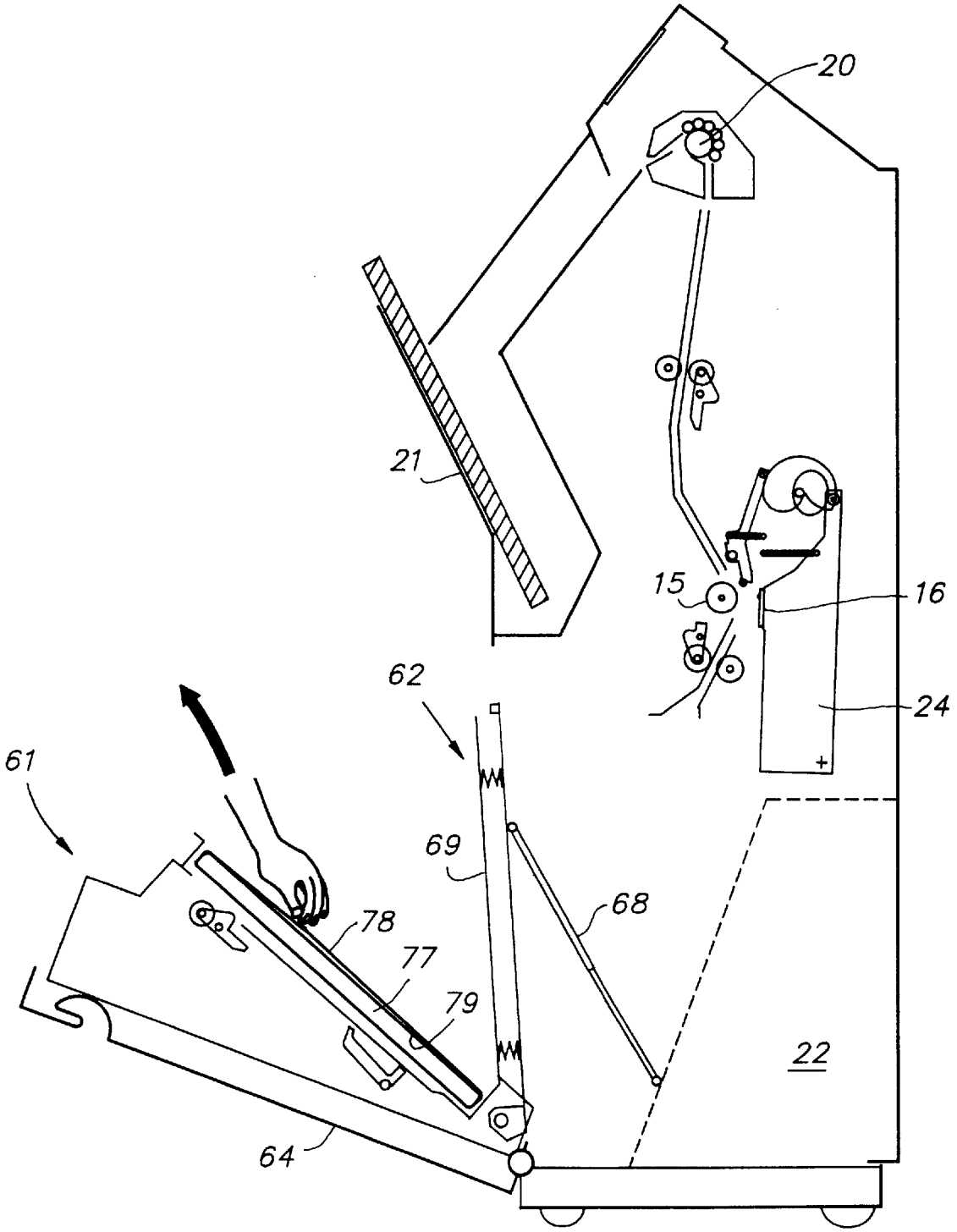
FIG. 10 shows the removal of the strap keeping the stack of sheets together.

The operator removes sealing tape 76, see FIG. 8, and then withdraws wrapper 73 from the sheet stack by means of its tail portion 74, see FIG. 9. The sheets of stack 77 are still held together by an encircling band or strap 78 which prevents mutual movement of the sheets as their wrapper is removed, or the remaining of one or more sheets in the removed wrapper. This strap is detached and next removed, see FIG. 10.

We have found that it is desirable to protect the upper sheet of the stack of sheets, and to a lesser degree the underlying ones, against finger marks and finger pressure by means of a protective foil or board 79. The strap just described may be removably attached to such board to further exclude mutual movements of the sheets during their loading. The mentioned protective board, e.g. a sheet of polypropylene or the like with a thickness of approximately 1.0 mm, remains on the stack.

Figure 11:
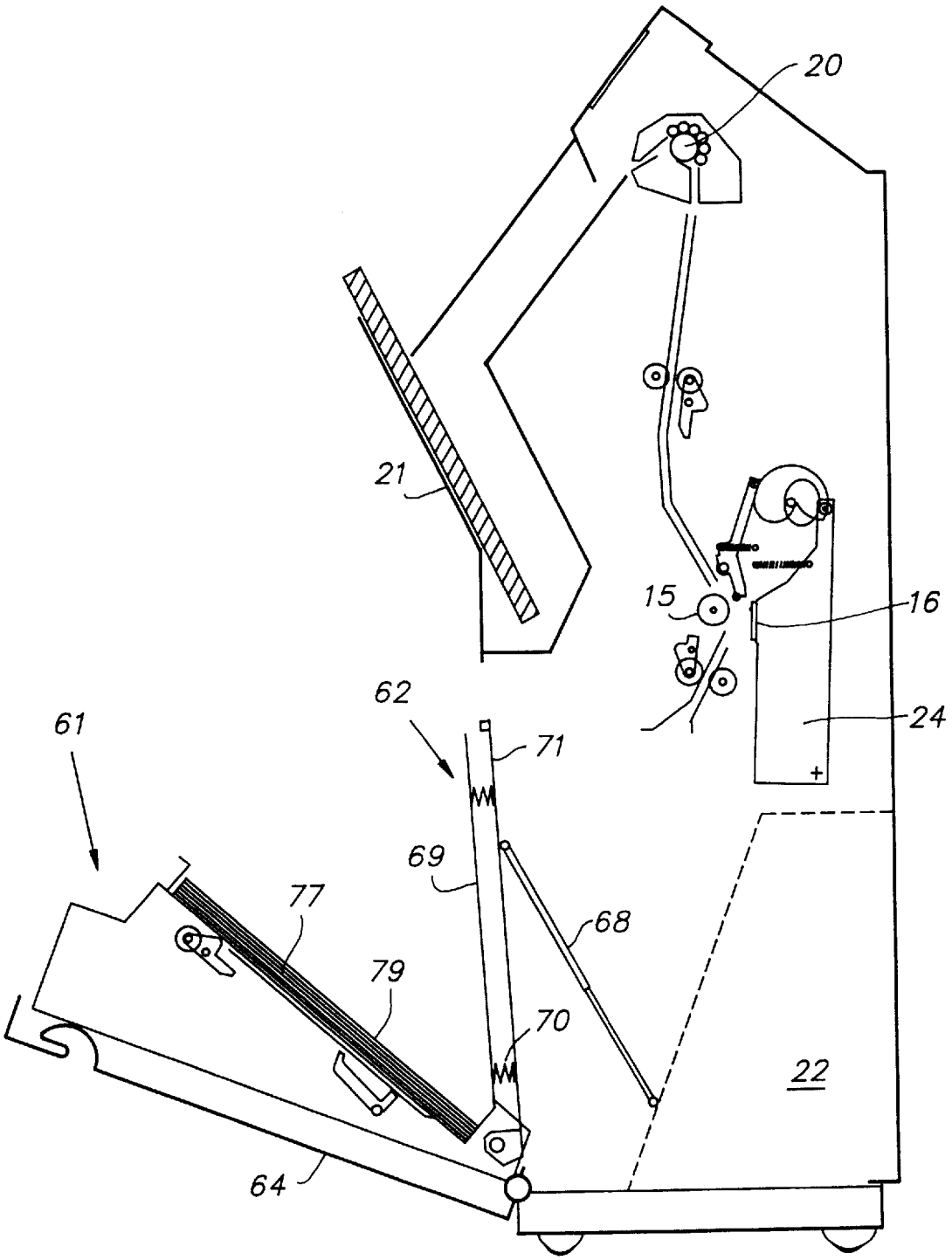
FIG. 11 shows the loaded magazine.

The magazine being loaded as shown in FIG. 11, lid 64 is now closed by swinging it in the position as shown in FIG. 1. As compartment 61 has reached a nearly vertical position, protective board 79 comes in contact with pressure plate 69. Further closing of the lid causes the sheets first to compress springs 70 and next to swing magazine compartment 62 inwardly, thereby compressing gas spring 68 until the operative dispensing position of FIG. 1 is obtained. In this position the upper sheet of the stack is withheld only by engagement of its trailing and leading margins by corresponding lips of the magazine, and thus engagement of the sheet by dispensing roller 13 provokes its removal from the stack as described hereinbefore.

The apparatus described hereinbefore can easily be adjusted to smaller sheet sizes. Such adjustment may comprise brackets such as 80 shown in broken lines in FIG. 6 which can be fitted at different heights in the magazine and which reduce the available length for the sheets.

Sheet stop 44 needs to be adjusted accordingly and this may occur by arranging wall 56 for the mounting of such stop at different heights.

Figure 12:
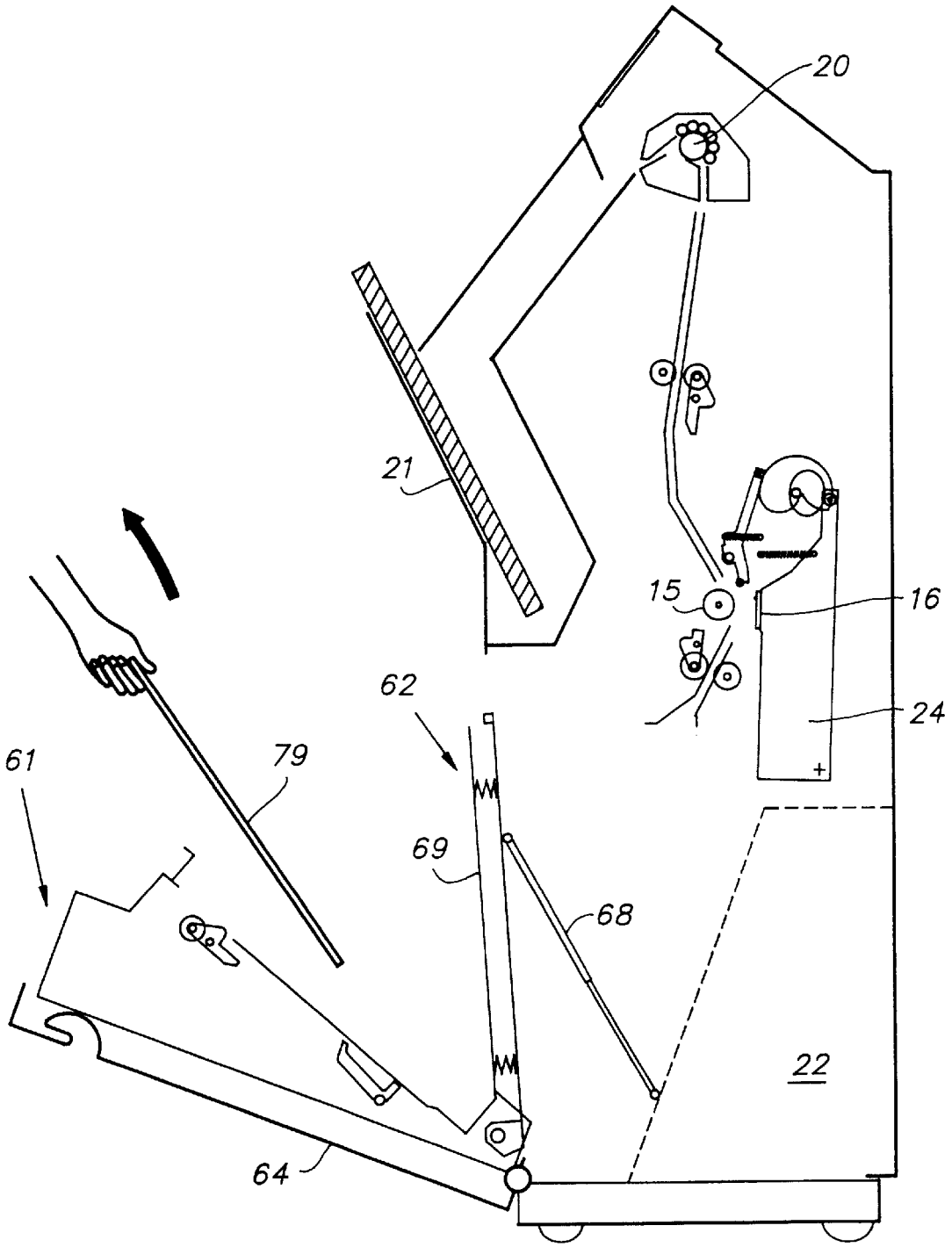
FIG. 12 shows the removal of the protective foil from the magazine.

After all the sheets of the sheet stack have been printed protective foil 79 remains in magazine 11. After the magazine has been opened, see FIG. 12, this foil has to be taken away as shown by the bold arrow before a next sheet pack can be loaded.

The printer according to the present invention includes also a mechanism for the lateral positioning of a sheet taken from the stack of sheets. The introduction of this specification will have made it clear that a margin of uniform width is important for the appearance of the printed image, and in consequence an accurate lateral position of the sheet is important as well.

Parts list:

| | |
|---|---|
| 10 | housing |
| 11 | magazine |
| 12 | stack |
| 13 | dispenser roller |
| 15 | print drum |
| 16 | thermal head |
| 17 | pressure roller |
| 18 | guides |
| 19 | driving rollers |
| 20 | de-curl roller |
| 21 | outlet tray |
| 24 | frame |
| 25 | axis |
| 26 | follower roller |
| 27 | cam |
| 28 | spring |
| 29 | frame |
| 30 | shaft |
| 31 | follower roller |
| 32 | cam |
| 34 | spring |
| 35 | shaft |
| 38 | sheet |
| 40 | sheet path |
| 41, 41' | feeding rollers |
| 43 | arm |
| 44 | stop |
| 45 | arm |
| 46, 47 | pivots |
| 48, 49, 50, 51 | gears |
| 52, 53 | legs |
| 54 | pivot |

-continued

| | |
|---|---|
| 56 | wall |
| 61, 62 | magazine compartments |
| 63 | hinge |
| 64 | lid |
| 65 | hinge |
| 67 | handle |
| 68 | gas spring |
| 69 | pressure plate |
| 70 | springs |
| 71 | bottom |
| 72 | sheet pack |
| 73 | wrapper |
| 74 | tail portion |
| 75 | front portion |
| 76 | seal |
| 77 | pack |
| 78 | strap |
| 79 | protective foil |
| 80 | bracket |

We claim:

1. A thermal printer, comprising:

a thermal head for image-wise heating a heat-sensitive sheet according to an elongate printing zone, transverse with respect to the sheet, the sheet having a leading end and a trailing edge;

a rotatable, driven print drum for conveying the sheet past said thermal head, a gap being formed between said thermal head and said print drum before the printer prints the sheet;

sheet feeding means;

sheet stop means; and the printer having a sheet-forwarding mode and a sheet returning mode, the sheet feeding means being operative in the sheet-forwarding mode to move a sheet with its leading end through said gap beyond a correct position the sheet should take at the start of printing, and in the sheet-returning mode to move the sheet backwardly to contact said sheet stop means with its trailing edge for longitudinal alignment of the sheet, thereby to obtain with the leading end the correct printing start position of the sheet in said gap.

2. A thermal printer according to claim 1, wherein said print drum and said thermal head are disposed in such a way that a sheet, being freely passed through said gap before the printer prints a sheet, follows a nearly upward course.

3. A thermal printer according to claim 2, wherein the sheet feeding means is in frictional contact with the sheet in the sheet-forwarding mode, and is disengaged from the sheet in the sheet-returning mode thereby allowing the sheet to move back onto the sheet stop means.

4. A thermal printer according to claim 3, further comprising a magazine for receiving a stack of supply sheets, wherein said sheet feeding means is also operative to dispense a sheet from said magazine.

5. A thermal printer according to claim 3, which comprises additional sheet driving means for supplementing the effect of gravity during the returning motion of a sheet.

6. A thermal printer according to claim 1, further comprising means for adjusting the position of the stop means to meet different sheet sizes.

7. A thermal printer according to claim 4, wherein the stop means rests on the top sheet of the stack of sheets.

8. A thermal printer according to claim 1, comprising a magazine tilted inwardly of the printer for holding a stack of sheets in a tilted position, and dispenser means for dispensing each time the upper sheet from a stack of sheets held in such position.

9. A thermal printer according to claim 8, wherein the magazine is mounted for pivotation about a horizontal axis so that it can swing outwardly of the printer to take an outwardly tilted position for being loaded with fresh sheets.

10. A thermal printer according to claim 9, wherein the magazine is composed of two compartments pivotally connected with each other, the magazine being swingable from the inwardly tilted position to an intermediate position in which both compartments take a nearly vertical position, and next to the loading position in which the innermost compartment keeps a nearly vertical position but the outermost one swings to the outwardly tilted position for being loaded.

* * * * *